United States Patent [19]

Tuckey

[11] Patent Number: 4,521,164

[45] Date of Patent: Jun. 4, 1985

[54] ROTARY FUEL PUMP WITH PULSE MODULATION

[75] Inventor: Charles H. Tuckey, Cass City, Mich.

[73] Assignee: Walbro Corporation, Cass City, Mich.

[21] Appl. No.: 573,285

[22] Filed: Jan. 23, 1984

[51] Int. Cl.[3] ..... F04B 39/02; F04B 49/08; F16L 55/04

[52] U.S. Cl. ..... 417/307; 417/366; 417/540; 417/310; 138/31

[58] Field of Search ..... 417/366, 540, 542, 307, 417/310; 138/26, 30, 31

[56] References Cited

U.S. PATENT DOCUMENTS

| | | | |
|---|---|---|---|
| 912,502 | 2/1909 | Squires | 138/31 |
| 2,703,108 | 3/1955 | McCuistion | 138/31 |
| 3,366,144 | 1/1968 | Durst | 138/26 X |
| 4,181,473 | 1/1980 | Ina | 417/366 X |

FOREIGN PATENT DOCUMENTS

| | | | |
|---|---|---|---|
| 2637979 | 3/1978 | Fed. Rep. of Germany | 417/366 |
| 2069052 | 8/1981 | United Kingdom | 417/540 |
| 2107789 | 5/1983 | United Kingdom | 418/15 |

*Primary Examiner*—Carlton R. Croyle
*Assistant Examiner*—Ted Olds
*Attorney, Agent, or Firm*—Barnes, Kisselle, Raisch, Choate, Whittemore & Hulbert

[57] ABSTRACT

A rotary pump for pumping liquid which includes a rotor combination in the form of a vane pump or gear and rotor with pumping chambers disposed circumferentially around the rotor. The chambers progressively increase in the inlet area and ensmall in the outlet area. Pulse absorbtion means are interposed in the fuel passage means to absorb pulses and smooth out the pressurized outlet liquid, thus reducing the pump noise under all conditions of operations.

2 Claims, 8 Drawing Figures

ROTARY FUEL PUMP WITH PULSE MODULATION

Reference is made to my copending U.S. application, Ser. No. 403,097, filed July 29, 1982.

FIELD OF INVENTION

Electric fuel pumps utilizing a rotary pump and electric drive housed together for mounting on a vehicle or in a vehicle fuel tank.

BACKGROUND OF THE INVENTION

Rotary fuel pumps driven by an electrical powering device have been utilized for some years in some vehicles either as original equipment or as appliances to supplement the original fuel supply system. The pump and power unit are frequently in a common housing as shown, for example, in U.S. Pat. No. 4,401,416, issued Aug. 30, 1982, to Charles H. Tuckey.

Since the pumps are frequently mounted in the fuel tanks of a vehicle, the noise factor is extremely important. A pump under load will normally produce more noise and this may be audible as a humming noise, to an annoying degree, to passengers in the vehicle. Various pulse dampening devices have been tried with some success; but since they usually involve material such as a closed cell foam material or a hollow pulse dampening chamber of a synthetic flexible material, the useful life of these devices is limited by the vulnerability of the material in the presence of hydrocarbons.

It will be appreciated that in the pumping cycle as one pumping cell is exhausting, another cell is taking in fluid at the same time. In other words, intake and exhaust pressure waves are timed with one another, and normally the quantity of fluid being exhausted from each cell is the same as that being taken in by another cell.

It is an inherent characteristic of a positive displacement pump to produce slight pressure pulses each time one of the multiple vanes passes through its pumping cycle. For example, a roller vane rotary pump produces an audible humming noise when operating at system pressure. This noise has a tendency to increase as the output pressure requirement is increased.

It has been a desire of manufacturers and users of positive displacement rotary pumps to reduce or eliminate pressure pulses in order to achieve a smooth, pulse-free flow of fluid out of a pump at desired operating pressure.

An object of the present invention is to allow the exhaust pressure peaks to counter the negative inlet pressure valleys thereby cancelling one another and attaining a smooth flow in and out of the assembly and at the same time reducing the pump noise.

This concept involves the utilization of a resilient member between the inlet and exhaust zones within the pump assembly. Thus, each time a pressure peak occurs in the exhaust fluid, the pressure can force the resilient member to yield or move toward the inlet fluid, thereby simultaneously off-setting the negative pressure which occurred at the same time on the inlet side.

It has been noted that pressure waves or pulses are present at the inlet, as well as the outlet, at all operating pressures.

One must acknowledge and deal with the extreme pressure differential between the inlet and exhaust sides of the pump. For instance, the inlet zone is usually at an average pressure close to atmospheric; and the outlet zone average pressure is much higher, i.e., 60 psi or more depending upon the operating pressure requirement of the pump.

To accommodate the extreme pressure differential, a spring force can be applied against the resilient barrier on the low pressure side creating balance with the high pressure side. This allows movement of the flexible barrier in harmony with pressure pulses, thereby producing a smooth, constant flow of fluid in and out of the pump.

Other objects of the invention will be apparent in the following description and claims in which the invention is described, together with details to enable a person skilled in the art to practice the invention all in connection with the best mode presently contemplated for the invention.

BRIEF DESCRIPTION OF THE DRAWINGS

Drawings accompany the disclosure and the various views thereof may be briefly described as.

DETAILED DESCRIPTION OF THE INVENTION AND THE MANNER AND PROCESS OF USING IT

Reference is made to my copending application, Ser. No. 06/557,468, filed 12/5/1983, relating to an electric fuel pump of the same general nature as will be described herein.

Figure 1:
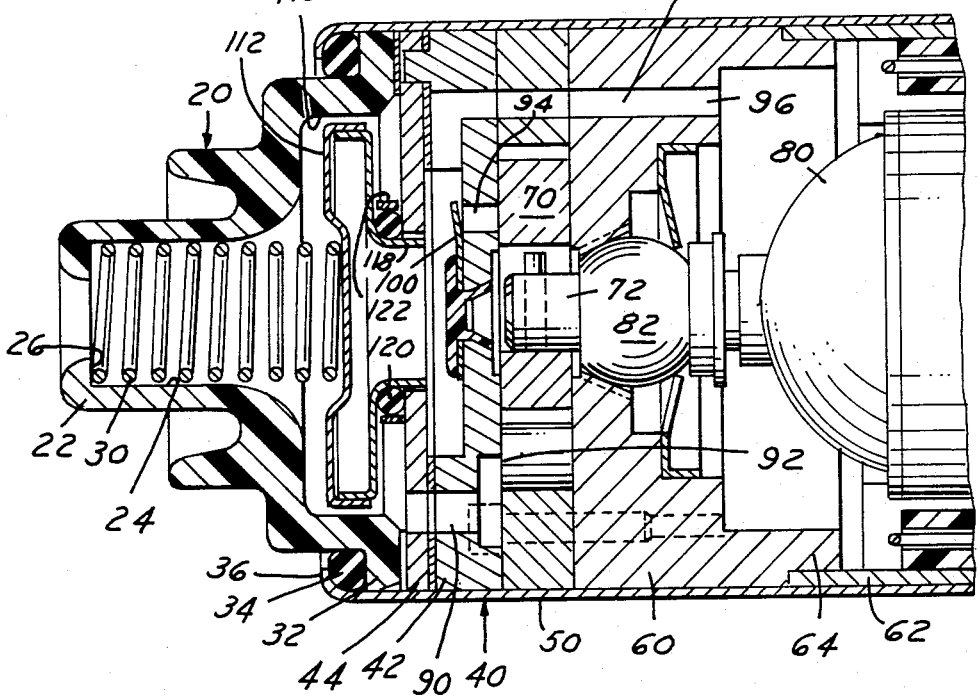
FIG. 1, a sectional view of the pump end of an electric pump assembly.

Referring to FIG. 1, an inlet housing 20 has a connector nipple 22 with an interior bore 24 terminating at the outer end in a shoulder 26 which serves as a seat for one end of a coil spring 30. The inlet housing enlarges to a radial flange 32 forming a shoulder against which is lodged an O-ring 34 retained in place by a turned-in end 36 of an exterior housing 40. This general assembly is shown and described in my U.S. Pat. No. 4,401,416, issued Aug. 30, 1983.

The inner surface of flange 32 bears against a pump inlet and outlet plate 42 with a ring disc 44 interposed and suitable sealing rings. A roller pump cam ring 50 is clamped between the plate 42 and a motor housing element 60 lying inside the outer container 40. A flux ring 62 telescopes over a flange 64 on element 60. Within the cam ring 50 is a roller pump rotor 70 driven by a shaft 72 on armature 80 of an electric motor. A spherical bearing 82 is journalled in element 60.

The inlet-outlet plate 42 has an inlet passage 90 opening to an inlet recess 92 adjacent pump rotor 70. An outlet port 94, one of a series, opens to an outlet passage 96 leading to the motor housing and an outlet connection at the other end of the pump. A reed valve 100 is biased against port 94 in a manner described in detail in my copending U.S. application, Ser. No. 557,468, filed Dec. 5, 1983.

Figure 3:
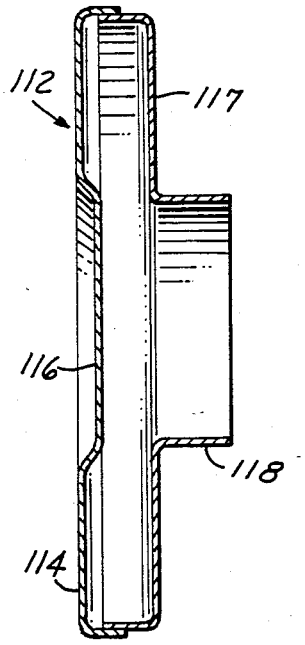
FIG. 3, a sectional view on line 3—3 of FIG. 2.
Figure 2:
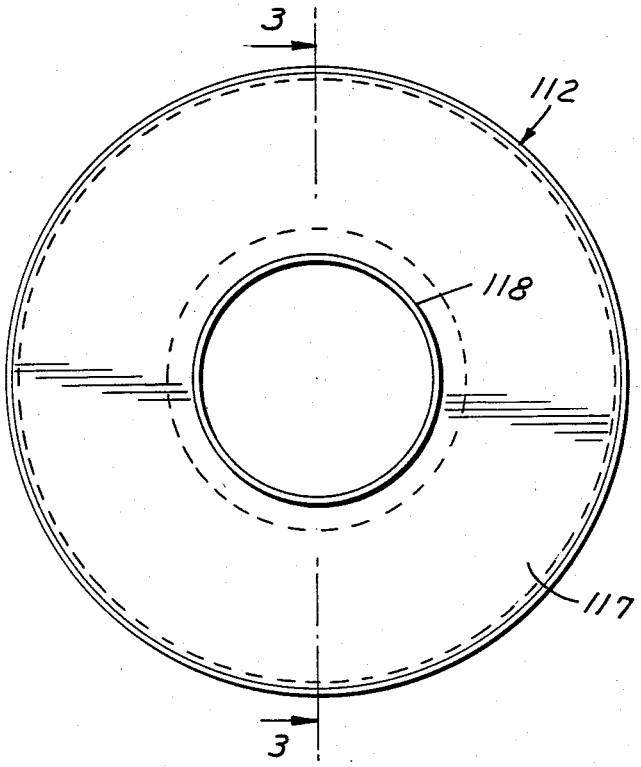
FIG. 2, an elevation view of the modulator element.

The bore 24 of inlet housing enlarges to a circular recess 110. In this recess is a hollow modulator element or bellows 112 shown also in FIGS. 2 and 3. The element 112 is made of thin sheet metal, preferably a stainless steel or phosphor bronze. A face plate 114 with a shallow spring seat recess 116 telescopes over a back plate 117 and is sealed at the rim in an air tight joint. The back plate has an axial flange 118 which is received in a central opening in the ring disc 44. An O-ring 120 is carried on the flange 118 and retained radially by a ring 122 (FIG. 1). The coil spring 30 bears at its inner end against the modulator element 112 seated in the shallow recess 116.

The O-ring seals the inner wall of the bellows 112 against the ring disc 44, but the bellows can move outwardly against the spring 30. The interior of the bellows is open to the outlet pressure from port 94. Accordingly, the bellows may move outwardly against the spring to by-pass the pump output which is above the calibrated setting of the spring 30 for pressure by-pass to the pump inlet.

Fluid from inlet bore 24 flows around the bellows 112 to inlet port 90 and thence to the roller pump. Outlet fluid under pressure passes out of port 94 to a radial passage in plate 42 leading to passage 96 and the motor housing, and eventual pump outlet at the other end of the pump housing.

The thin sheet metal from which the bellows is constructed will flex against the spring 30 to absorb pulses in the pump inlet and outlet, thus smoothing the flow from the pump. Thus, the bellows 112 serves as a pulse modulator and a relief valve.

Figure 4:
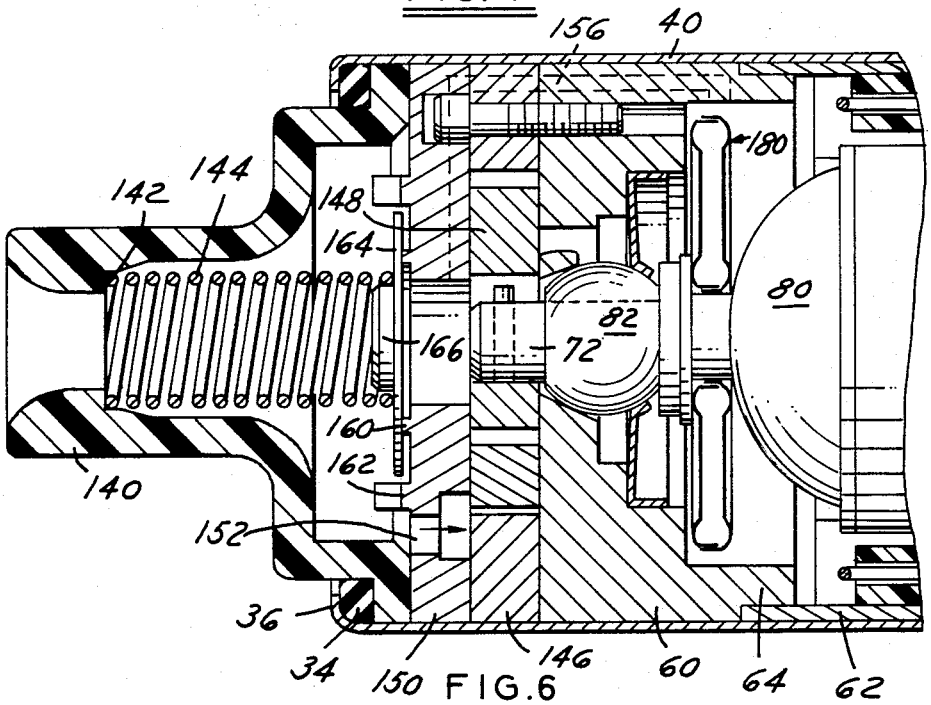
FIG. 4, a sectional view of a pump utilizing a modulator at the armature housing.

In FIG. 4, a modified structure is illustrated. Parts which are similar to those in FIG. 1 are marked with like reference characters. An inlet housing 140 has a bore with a shoulder 142 to seat one end of a coil spring 144. A pump cam ring 146 houses a rotor 148 of a roller pump driven by armature shaft 72. A pump inlet-outlet plate 150 is secured against the pump assembly having an inlet port 152 and an outlet recess 154 shown in dotted lines connected to an axially extending passage 156 leading to the armature housing and the ultimate pump outlet.

Figure 5:
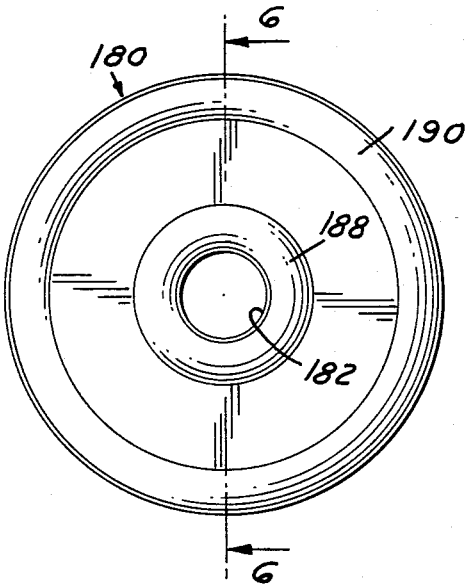
FIG. 5, an elevation of the modulator used in FIG. 4.
Figure 6:
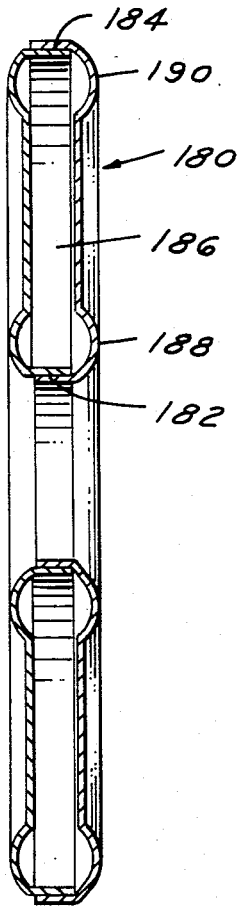
FIG. 6, an enlarged sectional view on line 6—6 of FIG. 5.

The plate 150 has a first inner annular ridge 160 inside a second ridge 162 with interruptions to provide a relief valve in conjunction with a plate 164 backed by the coil spring 144 seated at the plate end around a button 166. This is described in detail in my U.S. Pat. No. 4,401,416, referenced above. In this embodiment an annular bellows element 180 is mounted on shaft 72 between the armature 80 and the ball mount 82. The bellows, as illustrated in FIGS. 5 and 6, is formed from thin metal such as stainless steel or phosphor bronze to provide flexible walls. The bellows is a torus-shaped element formed of two annular sheets telescoped together at the inner and outer diameters 182 and 184. These joints are sealed to provide an air tight annular chamber 186. The element 180 is shaped to have annular bulges 188 and 190 with flat annular walls in between. These walls will flex in and out with the pulses of the pump output so that the output flow will be modulated into a relatively smooth flow.

Figure 7:
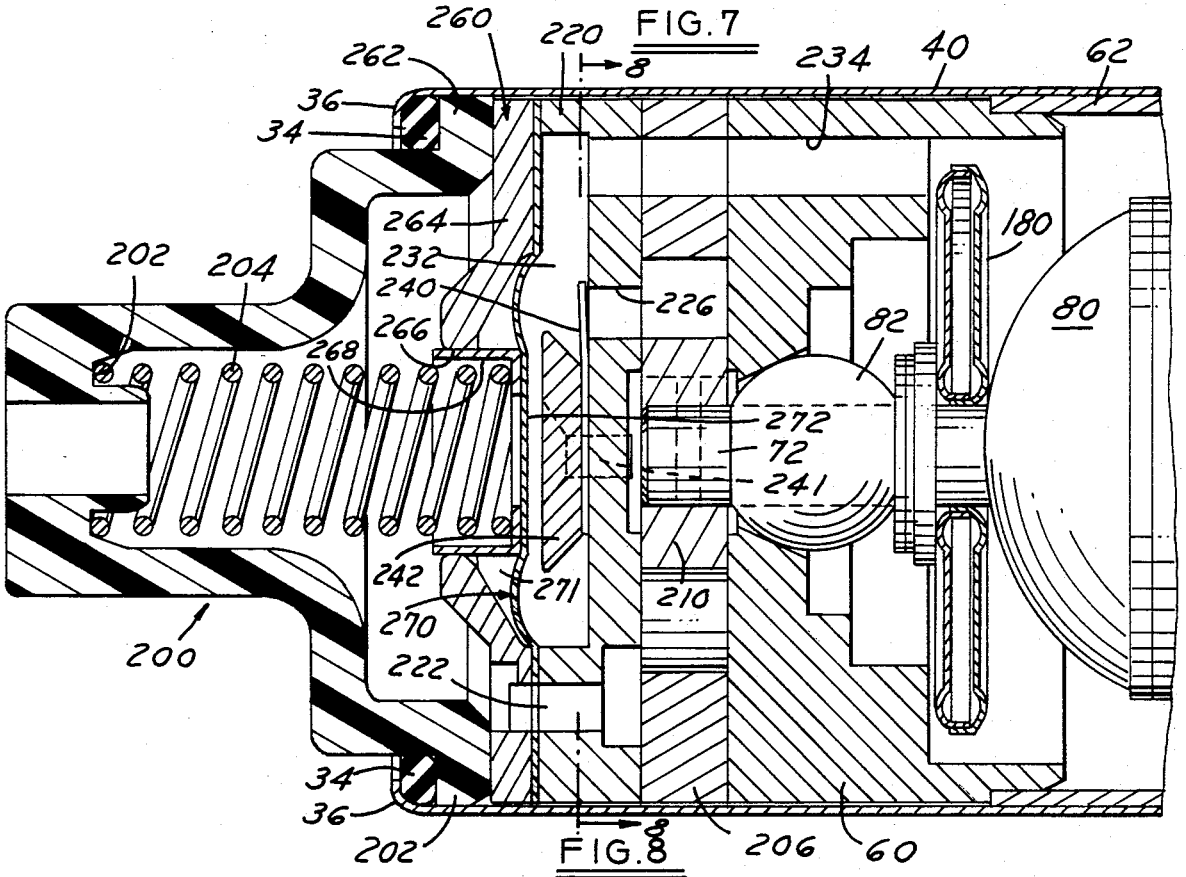
FIG. 7, a sectional view on line 7—7 of FIG. 8 of a modified device using a single wall modulator.
Figure 8:
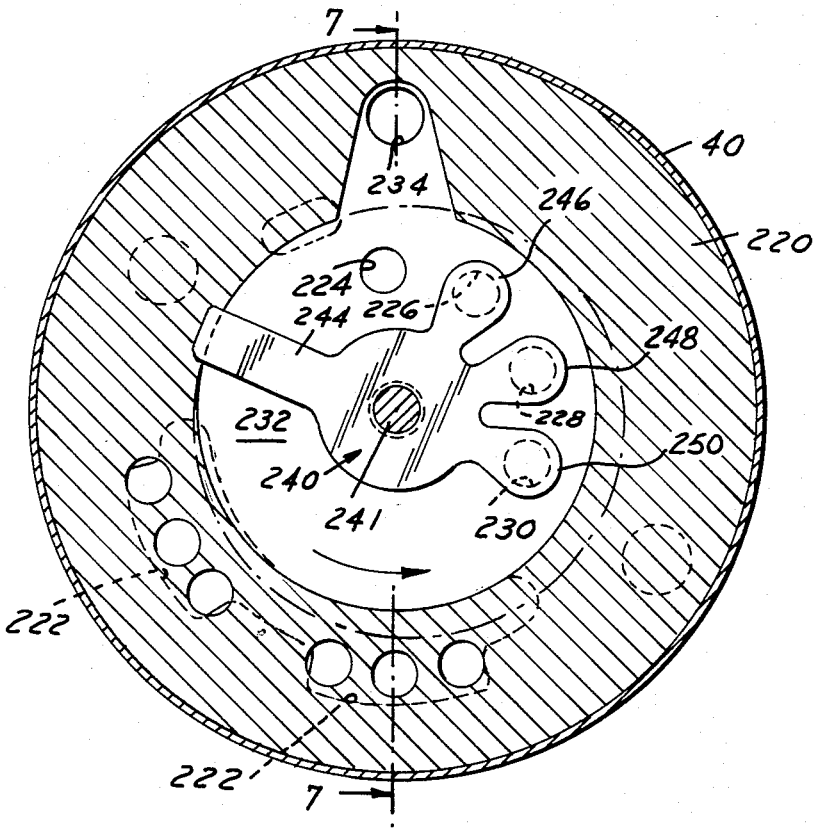
FIG. 8, a sectional view on line 8—8 of FIG. 7.

In FIGS. 7 and 8, another modification is illustrated. An inlet housing 200 has a shoulder 202 to provide a spring seat for coil spring 204. A pump cam ring plate 206 has a rotor recess housing a roller rotor 210 driven by shaft 72 on which it is mounted. An inlet-outlet plate 220, facing against the pump assembly 206, 210, has an inlet port 222 leading to the pumping recesses of the pump assembly and a series of outlet ports 224, 226, 228 and 230 (FIG. 8). These ports open to a recess 232 and an axial outlet passage 234 in communication with the armature chamber and the ultimate pump outlet.

The ports 226, 228 and 230 are closed by a three-fingered reed valve leaf 240 held against plate 220 by a headed screw 241 in a disc 242. A finger extension 244 stabilizes the reed valve leaf in proper orientation. The function of this assembly is fully described in my copending application, above referenced. The reed valve 100 in FIG. 1 is like that shown in FIG. 8. In general, the flexible fingers 246, 248 and 250 overlying ports 226, 228 and 230 allow outlet flow under pressure but in the event of cavitation (vapor formation) due to high ambient temperatures, the fingers prevent impacting backflow into the pump recesses which is a source of noise in pump operation.

An additional modulator plate 260 is interposed between the flange 262 of inlet housing 200 and the inlet-outlet plate 220. This plate 260 has a flat outer edge rim 264 and an inner central portion which curves outwardly and terminates in a central hole 266. A cup 268 in hole 266 provides a seat for the inner end of coil spring 204.

A modulator sheet 270 has a central flat portion 272 lying against the bottom of cup 268. The sheet 270 is clamped at its peripheral edges between flange 262 and plate 220. The plate 270 is made of a thin flexible material such as stainless steel or phosphor bronze so that the center portion can flex in response to outlet pressure of the pump. The disc 242 provides an inner stop surface. The chamber 271 between sheet 270 and modulator plate 260 is hermetically sealed.

Also, in FIG. 7, a toroidal pulse modulator is mounted on shaft 72 adjacent the armature as shown in FIG. 4 and described in connection therewith.

In the operation of the embodiment of FIGS. 7 and 8, the flexing of the pulse modulator sheet 270 serves to absorb and smooth out the pulsing outlet of the positive displacement pump assembly. The toroidal modulator 180 in the armature chamber also functions in the same way as previously described to reduce pulsations and provide a commensurate reduction in the noise and vibration of the pump.

The preferred material for the pulsing elements has been described as preferably formed of thin stainless steel or phosphor bronze. This material has sufficient flexibility and long life and is fully resistant to the hydrocarbon fuel. A dense plastic such as Nylon or Teflon might be substituted for some applications.

What I claim is:

1. In a rotary fuel pump which includes an elongate housing on a main axis having a main inlet housing at one end and a main outlet housing at the other end, that improvement which comprises:

(a) a rotary pump adjacent the main inlet housing rotating on said main axis, (b) an electric motor to drive said pump positioned between said pump and said main outlet, (c) a centrally apertured disc adjacent said pump disposed in a plane transverse to said main axis, (d) means forming a secondary pump outlet opening to space between said pump and said disc, (e) an inlet chamber formed in said main inlet housing having one end open to said disc, (f) a damper relief valve disposed in said inlet chamber comprising a damper chamber formed of flexible material having a first wall fully enclosing said damper chamber and a second wall spaced from said first wall and annularly sealed thereto, said second wall having an opening communicating with the central opening in said disc and open to said secondary pump outlet, and (g) a compression spring positioned in said inlet chamber to bear axially against said first wall, said second wall being sealed against said disc, said damper chamber being movable by pressure in said secondary pump outlet against said spring to relieve pump outlet pressure to said main inlet through the aperture in said disc.

2. A rotary fuel pump as defined in claim 1 in which said second wall has a neck portion extending through the central opening in said disc, and an annular sealing element at the base of said neck portion to bear against said disc movable away from said disc by pressure in said secondary pump outlet.

* * * * *